US009470408B2

(12) United States Patent
McGowan et al.

(10) Patent No.: US 9,470,408 B2
(45) Date of Patent: Oct. 18, 2016

(54) ILLUMINATION SYSTEM

(75) Inventors: Daniel B. McGowan, Glen Ellyn, IL (US); Victor Zaderej, Wheaton, IL (US); Mark A. Cole, Matteson, IL (US)

(73) Assignee: Molex, LLC, Lisle, IL (US)

( * ) Notice: Subject to any disclaimer, the term of this patent is extended or adjusted under 35 U.S.C. 154(b) by 6 days.

(21) Appl. No.: 14/113,850

(22) PCT Filed: Apr. 24, 2012

(86) PCT No.: PCT/US2012/034800
§ 371 (c)(1),
(2), (4) Date: Nov. 14, 2013

(87) PCT Pub. No.: WO2012/148910
PCT Pub. Date: Nov. 1, 2012

(65) Prior Publication Data

US 2014/0063814 A1 Mar. 6, 2014

Related U.S. Application Data

(60) Provisional application No. 61/478,701, filed on Apr. 25, 2011.

(51) Int. Cl.
*F21V 15/01* (2006.01)
*F21V 29/00* (2015.01)
(Continued)

(52) U.S. Cl.
CPC ..... *F21V 29/22* (2013.01); *F21V 7/00* (2013.01); *F21V 13/04* (2013.01); *F21V 15/01* (2013.01); *F21V 17/06* (2013.01); *F21V 17/12* (2013.01); *F21V 19/0035* (2013.01); *F21V 23/06* (2013.01); *F21V 29/004* (2013.01); *F21Y 2101/02* (2013.01)

(58) Field of Classification Search
CPC .... F21V 15/01; F21V 19/0035; F21V 29/22; F21V 29/004; F21V 17/12; F21V 17/06; F21V 23/06; F21V 7/00; F21V 13/04; F21Y 2101/02
See application file for complete search history.

(56) References Cited

U.S. PATENT DOCUMENTS 6,979,107 B1 * 12/2005 Benensohn ..... 362/374
7,985,005 B2 * 7/2011 Alexander et al. ..... 362/294
(Continued)

FOREIGN PATENT DOCUMENTS

KR 10-0926772 B1 11/2009
KR 20-0451488 Y1 12/2010
(Continued)

OTHER PUBLICATIONS

International Search Report for PCT/US2012/034800.

*Primary Examiner* — Anne Hines
*Assistant Examiner* — Jose M Diaz
(74) *Attorney, Agent, or Firm* — Jeffrey K. Jacobs

(57) ABSTRACT

An illumination system may include a receiver which is mounted on a support surface, such as a heat sink, and a light module that may include a cover and an LED assembly. The LED assembly is rotateably attached to the cover and seats within the receiver. The receiver may have touch-safe terminals attached thereto for providing power to the LED assembly. The LED assembly may include a cup which enables potting material to be easily included in the assembly during manufacturing. When the LED assembly is attached to the receiver, blades on the LED assembly mate with the terminals on the receiver.

17 Claims, 15 Drawing Sheets

(51) Int. Cl.

| | |
|---|---|
| ***F21V 7/00*** | (2006.01) |
| ***F21V 13/04*** | (2006.01) |
| ***F21V 17/06*** | (2006.01) |
| ***F21V 17/12*** | (2006.01) |
| ***F21V 19/00*** | (2006.01) |
| ***F21V 23/06*** | (2006.01) |
| *F21Y 101/02* | (2006.01) |

(56) References Cited

U.S. PATENT DOCUMENTS

| | | | | |
|---|---|---|---|---|
| 8,152,336 | B2 * | 4/2012 | Alexander et al. | 362/249.11 |
| 8,678,632 | B2 * | 3/2014 | Gallai et al. | 362/548 |
| 2005/0237746 | A1 * | 10/2005 | Yiu | 362/294 |
| 2007/0279921 | A1 * | 12/2007 | Alexander et al. | 362/368 |
| 2008/0092800 | A1 * | 4/2008 | Smith | H05B 33/0842 116/202 |
| 2009/0021529 | A1 * | 1/2009 | Wendler et al. | 345/619 |
| 2009/0059610 | A1 * | 3/2009 | Marshall | B60Q 3/0203 362/470 |
| 2009/0213595 | A1 | 8/2009 | Alexander et al. | |
| 2010/0051427 | A1 * | 3/2010 | Eikum | G06F 1/3203 200/51.02 |
| 2010/0067248 | A1 * | 3/2010 | Frey et al. | 362/538 |
| 2010/0127637 | A1 * | 5/2010 | Alexander et al. | 315/294 |
| 2011/0063849 | A1 * | 3/2011 | Alexander et al. | 362/294 |
| 2011/0075414 | A1 * | 3/2011 | Van De Ven et al. | 362/235 |
| 2012/0049733 | A1 * | 3/2012 | Gallai et al. | 315/32 |
| 2013/0051009 | A1 | 2/2013 | Zaderej et al. | |
| 2013/0070454 | A1 * | 3/2013 | Zeng | F21V 29/004 362/235 |

FOREIGN PATENT DOCUMENTS

| | | | |
|---|---|---|---|
| TW | M409356 | U | 8/2011 |
| WO | WO 2011/035054 | A1 | 3/2011 |
| WO | WO 2011/037656 | A1 | 3/2011 |

* cited by examiner

ILLUMINATION SYSTEM

RELATED APPLICATIONS

This application claims priority to U.S. Provisional Application No. 61/478,701, filed Apr. 25, 2011, which is incorporated herein by reference in its entirety.

FIELD OF THE INVENTION

The present invention relates to field of illumination, more specifically to an illumination system having a light emitting diode that is capable of being attached to a heat sink.

BACKGROUND OF THE INVENTION

A number of solid state lighting technologies exist and one of the more promising types is a light emitting diode (LED). LEDs have dramatically improved and now can provide high efficiencies and high lumen output. One long standing issue with LEDs, however, is that they are susceptible to damage if not protected from heat. Generally speaking, a LED will have a reduced life and less pleasing color output as the operating temperature of the LED increases. In addition to the issues with heat, the ability of an LED to act as a point source provides desirable lighting properties, but can be challenging to package in a manner that is convenient. Often LEDs are a permanent part of a fixture and while the life of a LED is quite long, there is still the problem of having to replace an entire fixture if the LED fails prematurely or even after the 20-50,000 hours of life. Certain designs exist for replaceable modules but they tend to be either DC-only type modules that are can be readily mounted in a fixture or relatively large modules that include AC to DC conversion functionality. Thus, further improvements in how LEDs are mounted would be appreciated by certain individuals.

SUMMARY OF THE INVENTION

An illumination system is disclosed that includes a receiver which is mounted on a support surface that acts as a heat sink, a cover and an LED assembly. The LED assembly is attached to the cover and seats within the receiver. The receiver has terminals attached thereto for providing power to the LED assembly. The LED assembly includes a housing which enables potting material to be easily included in the assembly during manufacturing. When the LED assembly is attached to the receiver, the terminals on the LED assembly mate with the terminals on the receiver.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
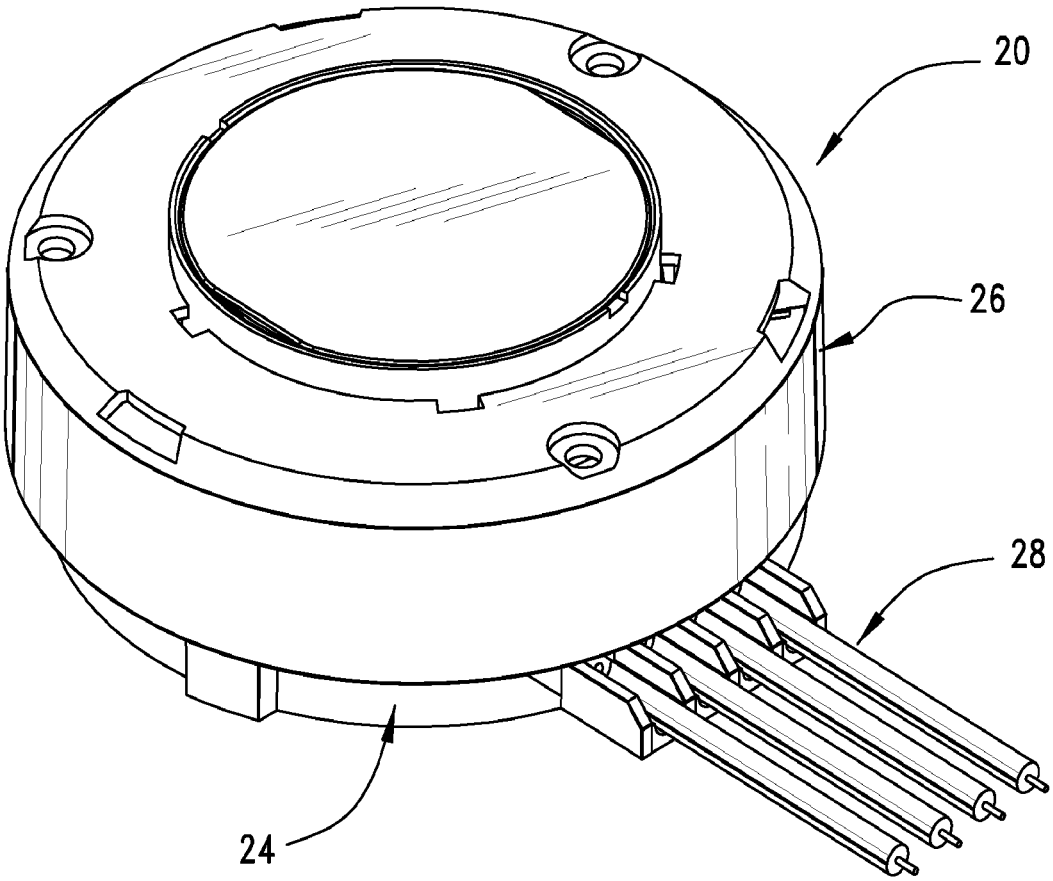
FIG. 1 is a perspective view of an embodiment of a light module assembly.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

A light module 20 is disclosed for mounting in a receiver 24. While the terms lower, upper and the like are used for ease in describing the light module 20, it is to be understood that these terms do not denote a required orientation for use of the light module 20. The light module 20 can be configured to provide an aesthetically pleasing appearance or if desired, can be configured to support optional aesthetic covers. As can be appreciated, other configurations with different appearances, such as square or some other shape light modules, as well as with different heights and dimensions are possible, particularly if the cover can be mounted after the light module is mated with the socket. One potentially significant benefit is that it can provide circuitry that can provide a conversion from AC to DC within the module itself. This allows the circuitry to be customized for a particular LED array. Therefore, it is possible to offer a light module that provides a desired light output and while allows for a future generation of the light module that also provide the same light output while using less power (due to, for example, improved LED technology). Furthermore, in certain embodiments, a receptacle can be provided to provides a touch-safe design while providing line voltage to the LED module. Thus the system depicted is well suited to being compatible with existing electrical systems and would not require installation of power conversion in the fixture (and/or wall) as is common in other LED based systems.

The light module 20 includes a LED assembly 22 and a cover 26. The light module 20 is intended to be mounted on a support surface 328, 328', see FIGS. 14 and 15, which may also be referred to as a heat sink, for dissipating thermal energy from the LED assembly 22. It should be noted that any desirable shape may be used for the support surface 328, 328' and the particular shape selected will vary depending on the application and the surrounding environment. Thus, the receiver 24 is placed on the support surface and receives the light module 20. As can be appreciated, the receiver 24 is coupled to a power source and in an embodiment the power can be provided by conductors 28.

The depicted LED assembly 22, see FIGS. 4-8, includes a LED module 30, a circuitry assembly 32 (which may be a printed circuit board or other desirable structure), an upper thermal pad 34, a heat spreader 36, a lower thermal pad 38, a cup 40 and a reflector 42 all of which are supported, directly or indirectly, by a frame 44. The circuitry assembly 32 is mounted on the cup 40 as described herein. The reflector 42 is positioned adjacent the LED module 30 and is supported by the cup 40 as described herein. Alternatively, the reflector 42 may be supported directly by the LED module 30. The upper and lower thermal pads 34, 36 are mounted on the heat spreader 36, which is, in turn, mounted on the cup 40. The heat spreader 36 is, in turn, fastened to the frame 44, as described herein, and in an embodiment can be heat-staked to the frame 44.

The LED module 30 includes a base 46, which typically provides a flat thermally conductive structure that can support an anode/cathode 48, 50 (potentially via an electrically insulative coating provided on a top surface of the base 46), and an LED array 52 which is mounted on the top surface of the base 46. As depicted, the base 46 is square and includes apertures 54 that can be used to secure the LED module 30 in position. It should be noted that while the heat spreader 36 and the base 46 are depicted as being separate elements that are thermally coupled via the upper thermal pad 34, in an alternative embodiment the heat spreader and base could be combined as a single element and the thermal pad 34 could be omitted.

Figure 6:
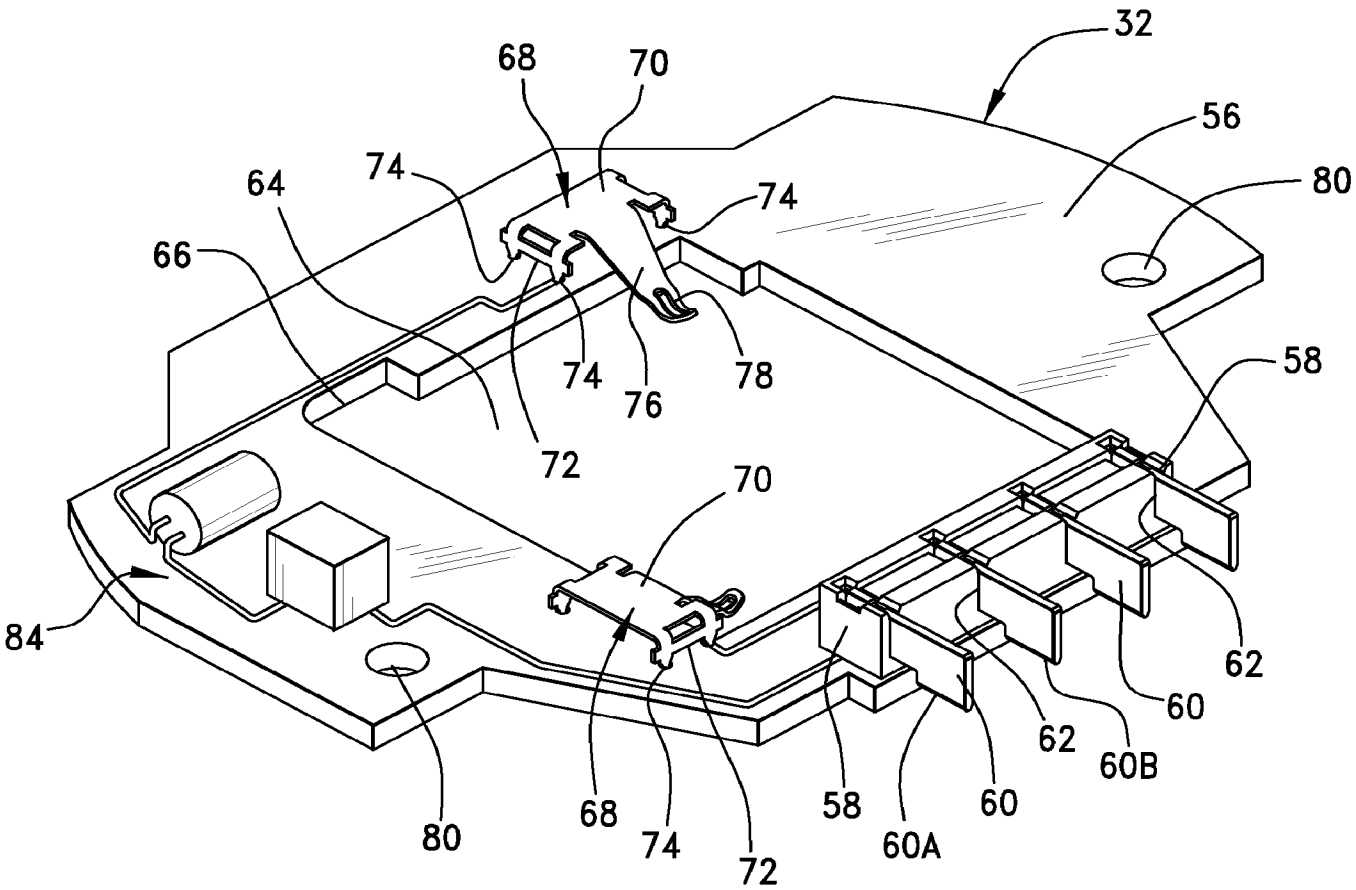
FIG. 6 is a top perspective view of an embodiment of a circuitry assembly which forms part of the LED assembly.
Figure 7:
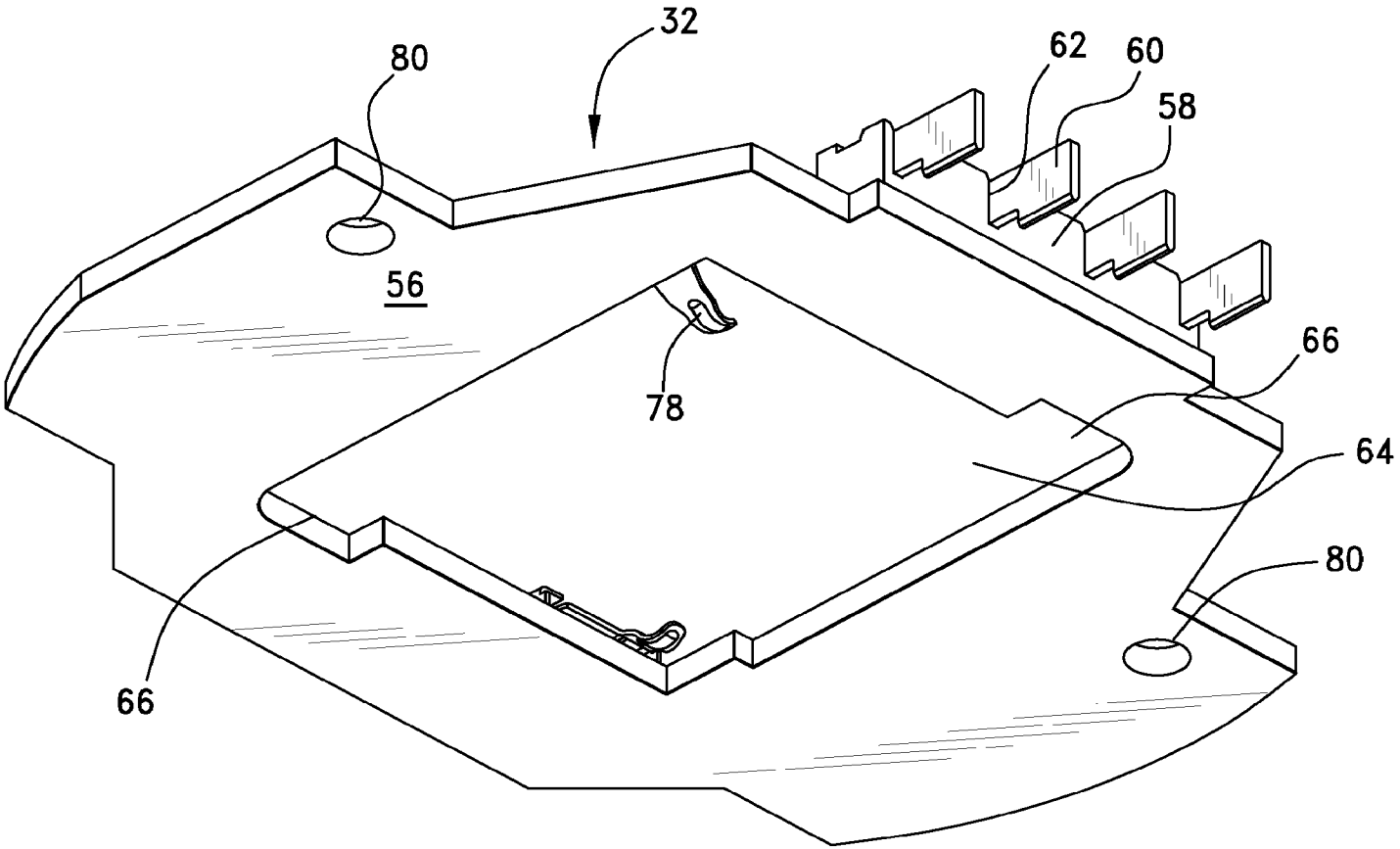
FIG. 7 is a bottom perspective view of the circuitry assembly.

As best shown in FIGS. 6 and 7, the circuitry assembly 32, as depicted, includes a board 56 (which as noted above, may be a PCB or any other structure suitable for supporting circuitry such as plastic substrate with traces provided thereon) with a connector 58, preferably on the edge thereof, and a plurality of conductive terminals 60 housed in the connector 58. The terminals 60 can be formed as blades and seat within associated slots 62 in the connector 58. As shown, four terminals 60 (two for power and two for controls) are provided. It is to be understood that other numbers of terminals 60 can be provided. The free end of each terminal 60 is enlarged and extends outwardly from the edge of the connector 58 and the board 56 so as to provide an exposed a plurality of exposed terminals. As can be appreciated, when the LED assembly is mounted in the receiver, the exposed blades can engage opposing contacts that are positioned in a recessed, touch-safe manner. Thus, the depicted design provides a beneficial construction suitable for use in higher voltage applications such as 120 VAC or 220 VAC applications. The terminals 60 can be connected to traces on the board 56 in a known manner (e.g., soldered, press-fit, etc.)

An aperture 64 is provided through the board 56 into which the base 46 of the LED module 30 seats. As such, as shown, the aperture 64 can be sized to correspond to the LED module. The aperture 64 includes a pair of notches 66 at two of the corners and the notches are sized to correspond to are for reasons described herein.

As depicted, a pair of conductive springs 68 are mounted on the board 56. Each spring 68 can be identically formed but in general includes at least one leg 74 that extends from a main body 70. The leg 74 includes one or more feet 74 which are electrically connected to the traces on the board 56. One or more arms 76 extends from the body 70 and extends into the aperture 64 and the arm 76 includes a free end 78 that is configured to engage the anode/cathode 48/50 of the LED module 30. The arm 76 is flexible such that it can be moved upwardly and downwardly relative to the plane defined by the board 56. It should be noted, however, that in an alternative embodiment the conductive springs 68 could be replaced with a simple conductor that was directly soldered to the board and the LED assembly.

A pair of apertures 80 extend through the board 56 and are spaced from aperture 64. The apertures 80 are used to attach the circuitry assembly 32 to the cup 40 as described herein.

Figure 4:
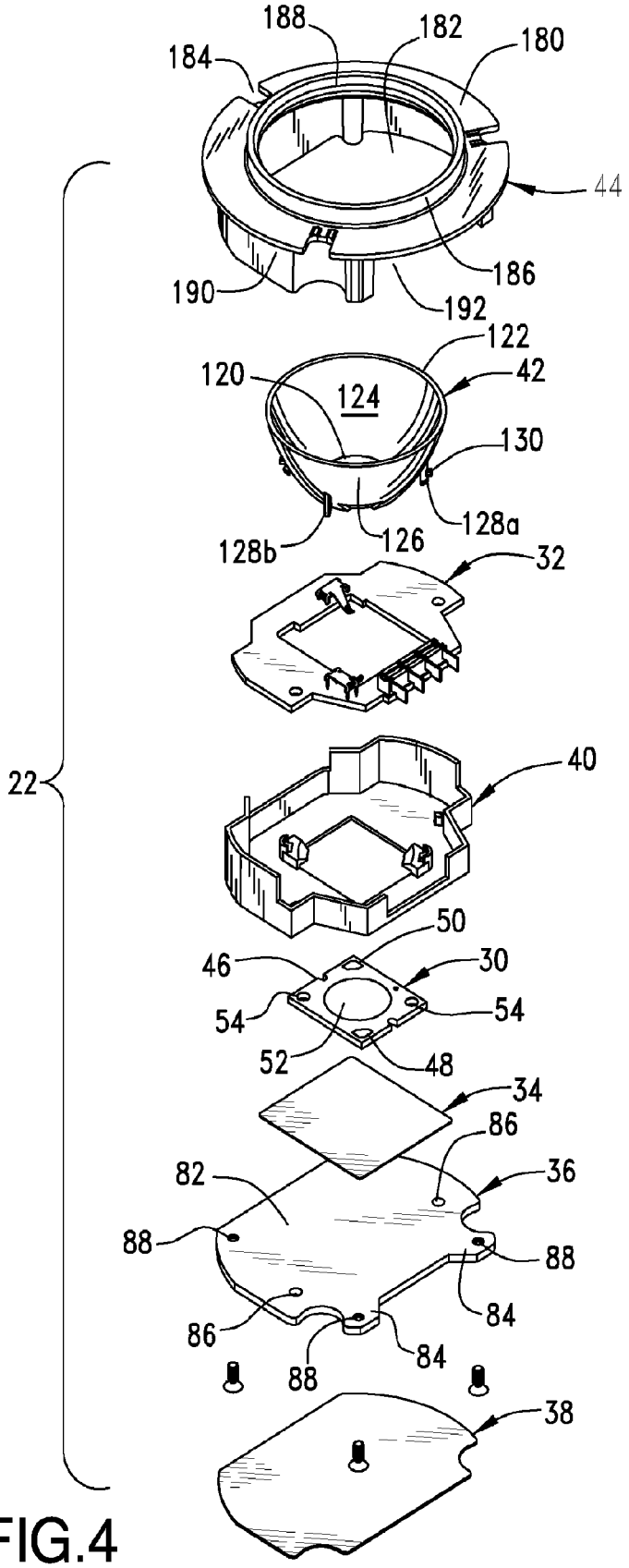
FIG. 4 is an exploded perspective view of the components of an embodiment of a LED assembly.

The heat spreader 36, FIG. 4, is a thin metal plate can be formed of copper or aluminum or other suitable material. The heat spreader 36 has a main body portion 82 and a pair of ears 84 which extend outwardly therefrom. Apertures 86 are formed through the main body portion 82 for attaching the heat spreader 36 to the cup 40 as described herein. Apertures 88 are provided through the main body portion 82 at the corners thereof opposite to the ears 84 and are provided through the ears 84 for attaching the heat spreader 36 to the frame 44 as discussed herein.

The upper thermal pad 34 is provided on and generally covers the middle section of the upper side of the main body portion 82 of the heat spreader 36, but does not cover the apertures 86. The upper thermal pad 34 is very thin, potentially 0.5-1.0 mm thick or even thinner. The lower thermal pad 38 is provided on and generally covers the lower side of the main body portion 82 of the heat spreader 36. Each thermal pad 34, 38 may be a conventional thermal pad material used in the industry to thermally couple two surfaces together, such as, but not limited to, 3M's Thermally Conductive Adhesive Transfer Tape 8810. If formed of the thermally conductive adhesive transfer tape, the thermal pads 34, 38 can be cut to the desired shapes from bulk stock and applied in a conventional manner and could have one side that includes an adhesive for adhering to the heat spreader 36. Of course, the thermal pads 34, 38 could also be provided via the use of a thermally-conductive paste or a thermally conductive epoxy positioned on the heat spreader 36. The benefit of using a thermal pad with an adhesive side is that the lower thermal pad 38 can be securely positioned on the heat spreader 36 and compressed between the heat spreader 36 and the resulting support surface 328, 328' (i.e. heat sink) while allowing the lower thermal pad 38 (and the associated components) to be removed if there is a desire to replace or upgrade those components.

Figure 8A:
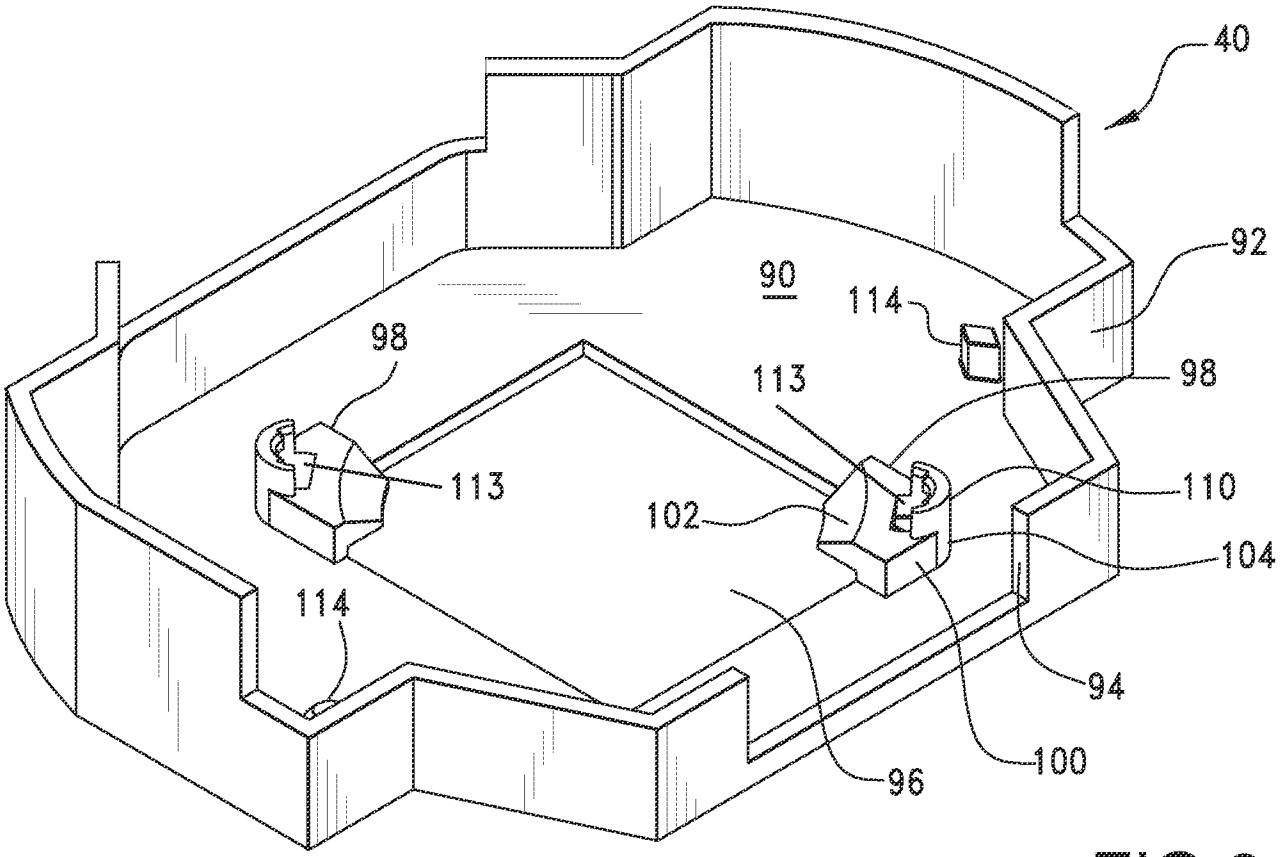
FIG. 8*a* is a top perspective view of a housing which forms part of the LED assembly.
Figure 8B:
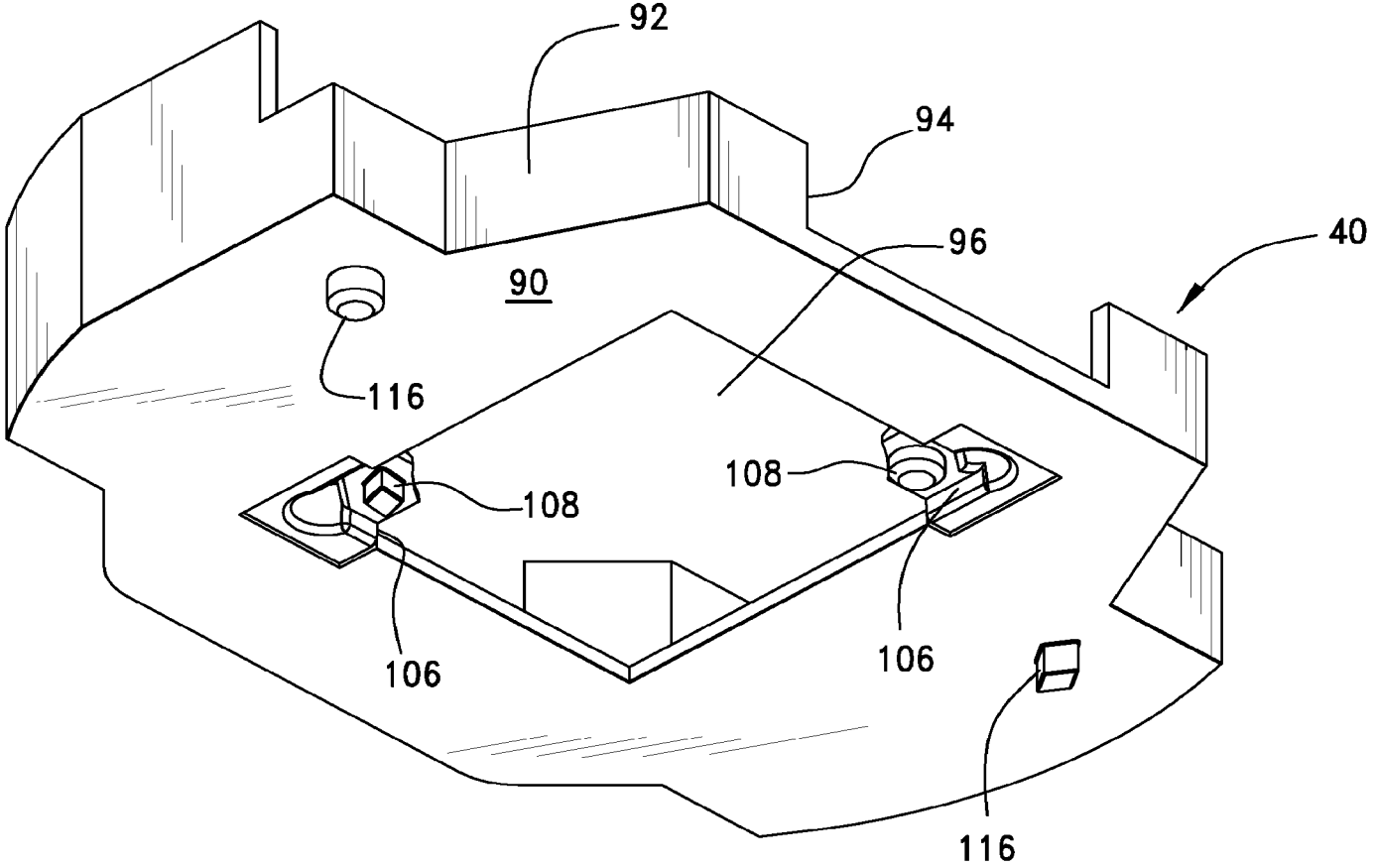
FIG. 8*b* is a bottom perspective view of the housing.

The cup 40, FIGS. 8 and 8*a*, is formed of an insulative material and has a base wall 90 and a side wall 92 extending upwardly from the base wall 90. The side wall 92 has a notch 94 provided therein to allow for the positioning of a connector. An aperture 96 extends through the base wall 90 and is spaced from the side wall 92. As illustrated, the aperture 96 is square and may correspond in shape to base 46 of the LED module 30.

Figure 5:
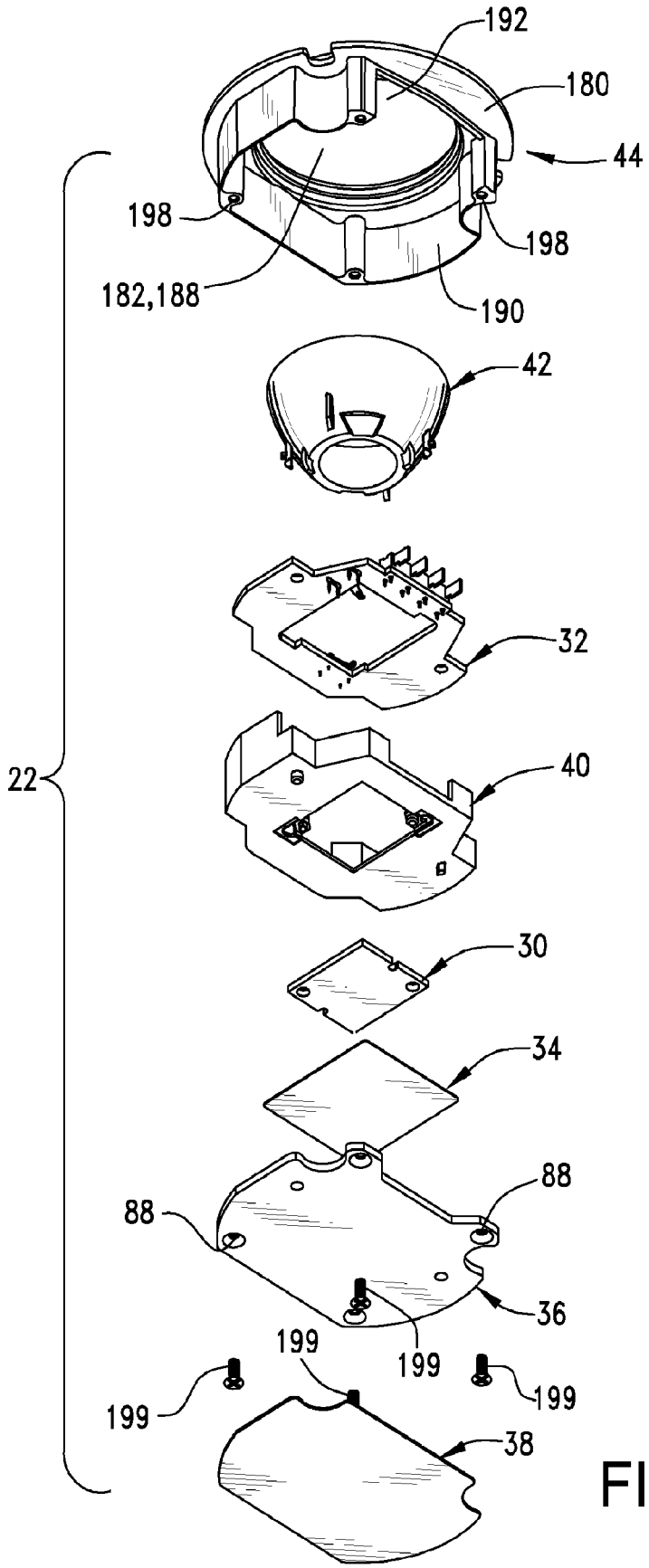
FIG. 5 is another exploded perspective view of the components of a LED assembly shown in FIG. 4.
Figure 9A:
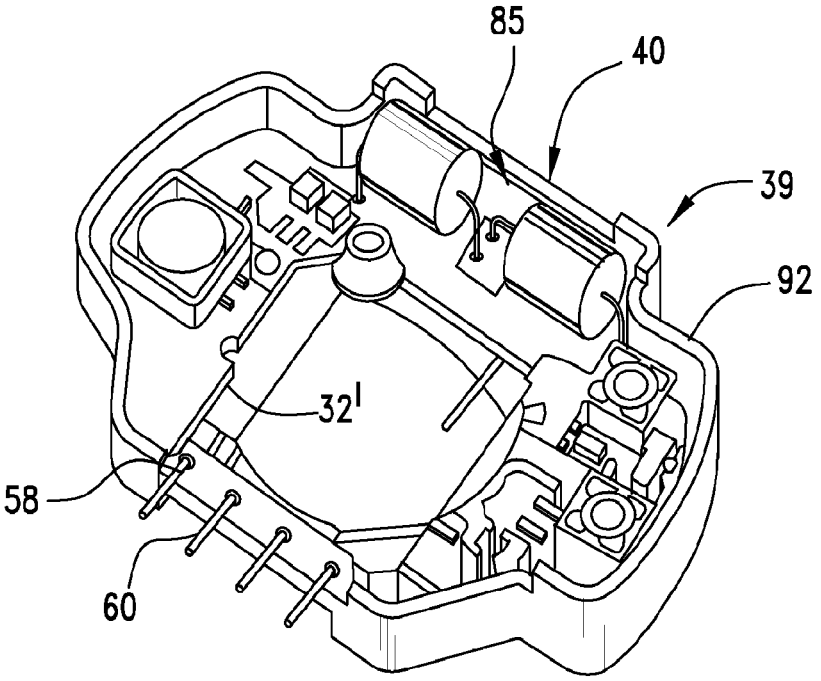
FIG. 9*a* is a perspective view of an embodiment of a cup assembly.
Figure 9B:
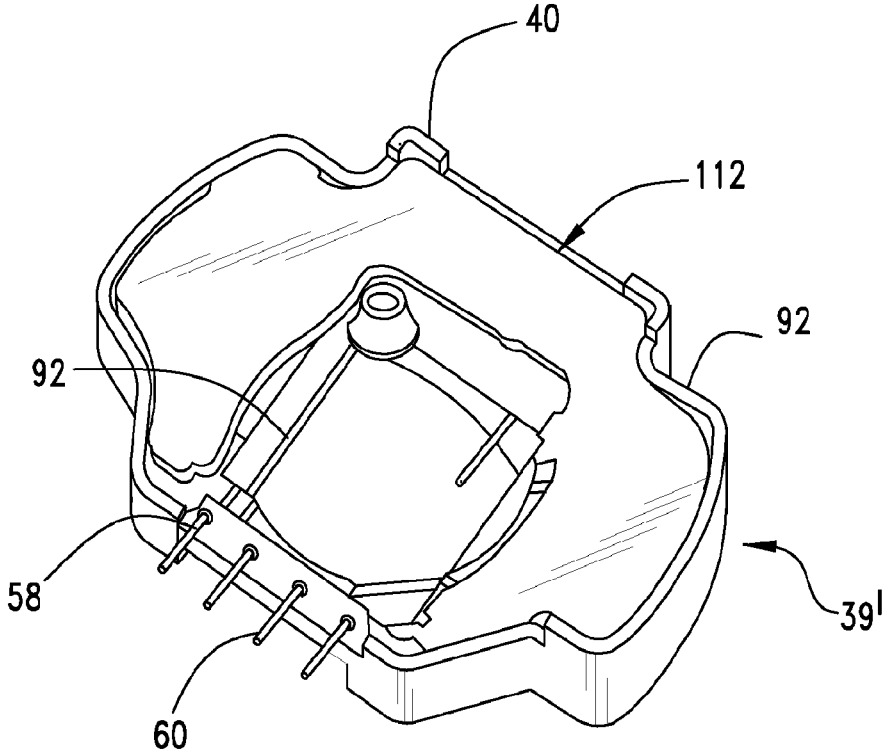
FIG. 9*b* is a perspective view of an embodiment of a cup assembly with potting material.

As can be appreciated from FIGS. 9*a* and 9*b*, a cup assembly can be formed with the cup 40. A circuitry assembly 32' that includes circuitry 85 is positioned in the cup 40 and the wall 92, in combination with the connector 58, provides an enclosure around the circuitry so that the cup assembly 39 allows for electrical separation and help ensure the cup assembly 39 meets desired Hipot requirements while providing terminals 60 that extend outwardly from the internal portion of the cup assembly so as to allow for an electrical connection with a corresponding receiver 24. As depicted, the cup assembly 39 has simple conductors that are intended to be soldered onto the anode and cathode of an inserted LED module. However, if desired, springs 68 (as depicted in FIGS. 5 and 6) may be used.

It should be noted that while the wall 92 is beneficial, the cup assembly 39 could omit the wall 92 and have the circuitry stacked more vertically so provide the desired Hipot performance.

A reflector mount 98 is provided at opposite corners of the aperture 96. Each reflector mount 98 has a body 100 which is generally shaped to align with the aperture 96 and as depicted has one corner 102 is cutoff and another corner 104 which is rounded. Corner 102 hangs over the aperture 96 and is opposed from corner 104. As a result of the cutoff, corner 102 is arcuate and tapers upwardly and outwardly from the aperture 96. A square cutout 106 is provided in lower surface of the body 100. In an embodiment, the thickness of the base 90 and the height of the cutout 106 can equal the height of the base 46 of the LED module 30 so that when the LED module 30 seats within the aperture 96 and cutouts 106, the bottom surface of the LED module 30 is flush with the bottom surface of the base 90. An extension 108 extends downwardly from the upper surface defining the cutout 106. As shown, the extensions 108 do not need to be like shaped. When the LED module 30 seats within the aperture 96 and cutouts 106, the extensions 108 seat within the apertures 54 provided in the base 46 of the LED module 30. The extensions 108 can be heat staked to the base 46 of the LED module 30 by known means. A curved wall 110 extends upwardly from corner 104. A recess 113 is provided in the body 100 proximate to the curved wall 110.

A pair of upper projections 114 extend upwardly from the upper side of the base wall 90 and are spaced from the aperture 96. As shown, the projections 114 do not need to be like shaped. A pair of lower projections 116 extend downwardly from the lower side of the base wall 90 and are spaced from the aperture 96. As shown, the projections 116 do not need to be like shaped.

As can be appreciated, the LED module 30, the circuitry assembly 32, the upper thermal pad 34, the heat spreader 36, the lower thermal pad 38 and the cup 40 can all be assembled together. For example, the circuitry assembly 32 can be seated in the cup 40 such that the lower surface of the board 56 seats against the upper surface of the base 90. The projections 114 extend into the apertures 80 in the circuitry assembly 32. The reflector mounts 98 can be positioned within the extensions 66 of the aperture 64, thus allowing the size of the system to be kept compact. As can be appreciated, the aperture 96 can be sized to generally conform to the size of the aperture 64. Each terminal 60 extends through the notch 94 such that a free end of each terminal 60 extends outwardly from the cup 40.

With the circuitry assembly 32 positioned in the cup 40 so as to provide cup assembly 39, the cup assembly 39 can be placed in a fixture configured to allow potting material 112, which can be a thermally conductive plastic or any desirable potting material, to be directed to the desired locations. As can be appreciated, the potting material 112 can be configured to substantially fill the cup 40, as depicted in FIG. 9*b*, to provide a cup assembly 39' that can be provided as a stand-alone assembly. Thus, the potting material 112 can extend so that it extends a height of the wall 92. The potting material 112 provides resistance to shock and vibration, and prevents moisture and corrosive agents from contacting the board 56. The potting material 112 also provides a path for thermal conduction of heat away from the elements on the board 56. The cup 40 and particularly the wall 92 provides a convenient means for holding the potting material 112, however if desired the wall 92 may be omitted and the fixture can be used to ensure the potting material is directed to the correct locations and to prevent potting material from going where it is not desired. After potting, the cup assembly 39' is removed from the fixture so that the aperture 64, extensions 66, springs 68, connector 58 and terminals 60 can be accessed.

The LED module 30 is then seated within the aperture 96 and cutouts 106 of the cup 40 and the extensions 108 extend through apertures 54 and can be heat staked to or snapped in place in apertures in the base 46. If springs 68 are used, the free ends 78 of the springs 68 engage the respective anode/cathode 48/50 on the LED module. Because the arms 76 are flexible, a good contact can be achieved between the free ends 78 of the springs 68 and the anode/cathode 48/50 without the need for soldering (which helps make the assembly process simpler and less costly). Of course, as can be appreciated from FIGS. 9*a* and 9*b*, simple conductors that are soldered to the anode and cathode are also contemplated for applications where the cost of soldering is less than cost of including the spring 68.

The heat spreader 36 is positioned to a bottom surface of the cup 40 and the orientation can be controlled by the use of projections 116 (which can extend through the apertures 86) and if desired, the projections 116 can be heat staked to the heat spreader 36 to help secure the heat spreader 36 to the cup assembly so that the upper thermal pad 34 is sandwiched between the LED module 30 and the heat spreader 36 and directly contacts the LED module 30. Alternatively, the heat spreader 36 can be attached to the cup 40 with standard fastening techniques such as threaded fasteners or any other suitable fastening approach. Since the upper thermal pad 34 can be made thin, it is possible to provide minimal thermal resistance between the heat spreader 36 and the LED module 30. In other words, the LED module 30 is in direct thermal communication with the upper thermal pad 34 and which is in turn in direct thermal contact with the heat spreader 36. The thermal interface between the LED module 30 and the heat spreader 36 can be controlled so as to reduce thermal resistivity to a level that can be less than 2 K/W and more preferably below 1 K/W. In certain embodiments, the thermal resistance can even be below 0.5 K/W. Naturally, this assumes the use of a thermal pad 34 with good thermal performance (conductivity preferably better than 2 W/m-K) but because of the larger area and the ability to use a thin thermal pad, acceptable performance is possible with a range of thermal pad materials.

The lower thermal pad 38 is attached to the underside of the heat spreader 36. When the light module 20 is positioned in a receiver 24, the lower thermal pad can make contact with a corresponding support surface (such as but not limited to support surface 328, 328') so as to allow for a dissipation of heat.

Figure 2:
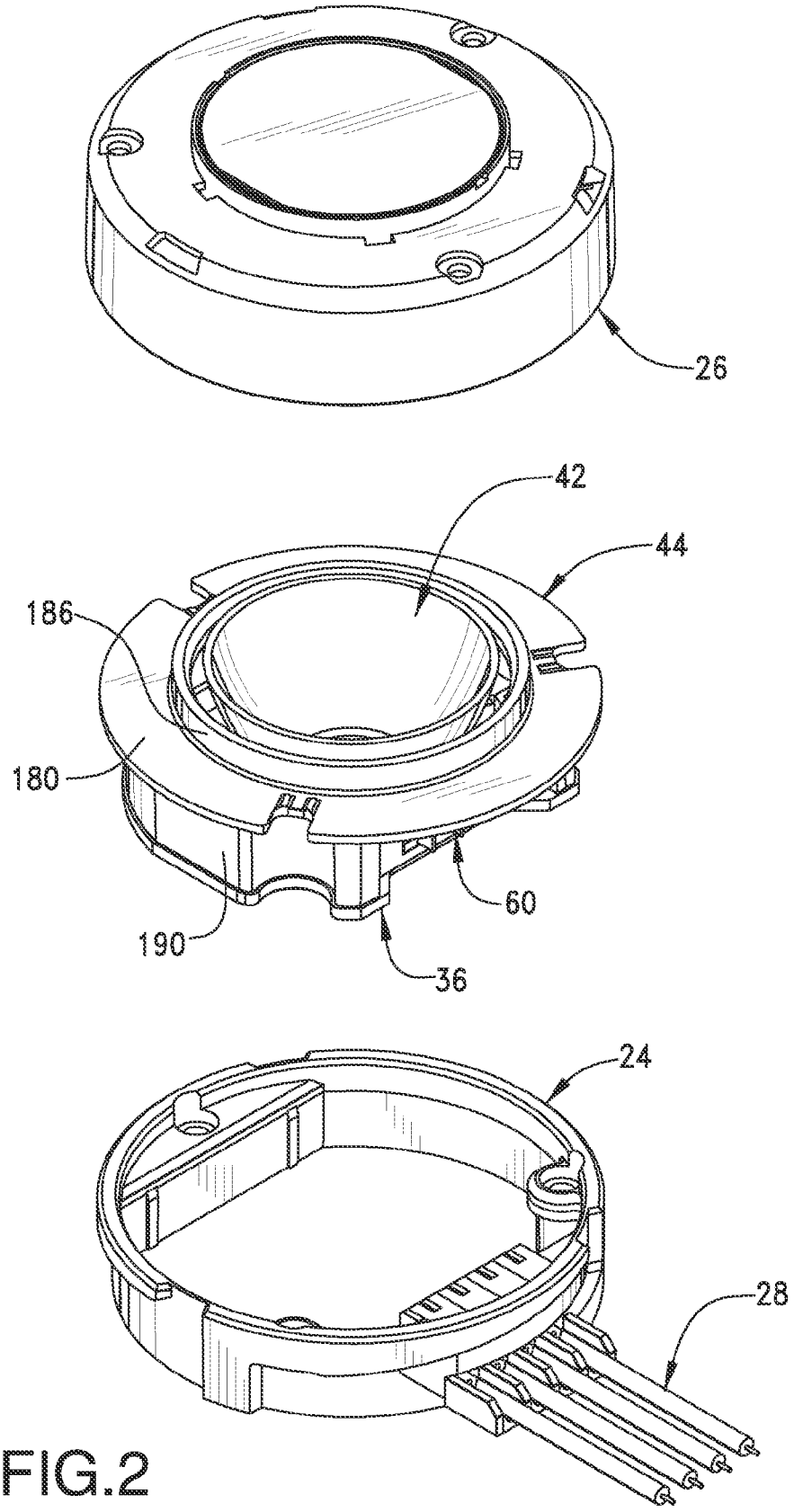
FIG. 2 is an exploded perspective view of the light module assembly depicted in FIG. 1.
Figure 3:
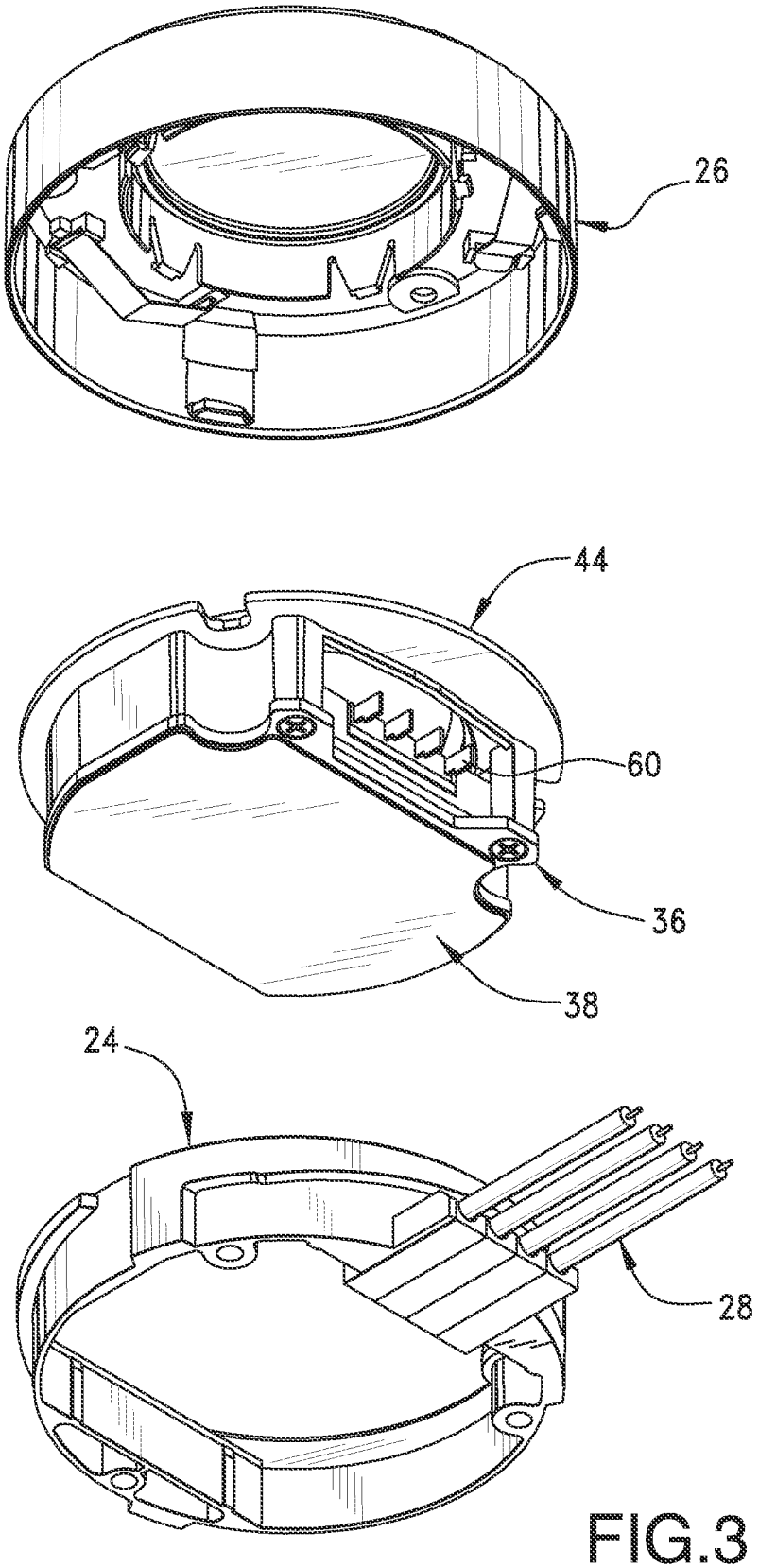
FIG. 3 is another exploded perspective view of the light module assembly depicted in FIG. 1.

As shown in FIG. 2, the reflector 42 is formed by an open-ended wall having a lower aperture 120 and an upper aperture 122. The wall includes an inner surface 124 and an outer surface 126. Typically, the inner surface 124 is angled and has its largest diameter at its upper end and tapers inwardly. The inner surface 124 of the reflector 42 (which may be faceted in a vertical and horizontal manner, or only in a vertical or horizontal, or without facets if a different effect is desired) may be plated or coated so as to be reflective (with a reflectivity of at least 85 percent in the desired spectrum) and in an embodiment may be highly reflective (more than 95 percent reflective in the desired spectrum) and may be specular or diffuse.

Four supports 128 are equidistantly provided around the wall and extend downwardly from the outer surface 126. Two of the supports 128*a* conform in shape to the recesses 112 in the projections 98. Supports 128*a* further include a protuberance 130 extending outwardly therefrom.

The reflector 42 mounts on the base 42 of the LED module 30, such that the LED array 52 is positioned within the lower aperture 120 of the reflector 42. The supports 128*a* seat within the recesses 112 in the projections 98 and the protuberances 130 engage with the top surfaces of the projections 98. The corner 102 of the reflector mount 98 conforms in shape to the outer surface 126 of the reflector 42. The supports 128*b* engage against the base 42 of the LED module 30. Therefore, the reflector 42 can be securely attached to the cup 40.

The frame 44, see FIGS. 4 and 5, is formed from a circular base wall 180 defining a passageway 182 therethrough. A plurality of cutouts 184, which as shown are three in number, are provided in the outer periphery of the base wall 180. A circular upper extension 186 extends upwardly from the base wall 180 and defines a passageway 188 which aligns with the passageway 182 through the base wall 180. A lower extension 190 extends partially around the base wall 180 and extends downwardly therefrom, such that a gap 192 is formed between the ends of the lower extension 190. The lower extension 190 is offset outwardly from the upper extension 186. A plurality of apertures 198 are provided in the bottom surface of the base wall 180 and receive fasteners 199 which extend through the apertures 88 in the heat spreader 36 to connect the heat spreader 36 and the frame 44 together. Other means for coupling the heat spreader 36 and the frame 44 together may also be provided. When the heat spreader 36 and the frame 44 are coupled together, the cup 40 and the circuitry assembly 32 seat within the passageway 182 and the reflector 42 seats within the passageways 182, 188. A space is provided between the reflector 42 and the upper extension 186. The connector 58 seats within the gap 192 and the free ends of the terminals 160 extend outwardly from the side wall 190 of the frame 44.

Figure 10:
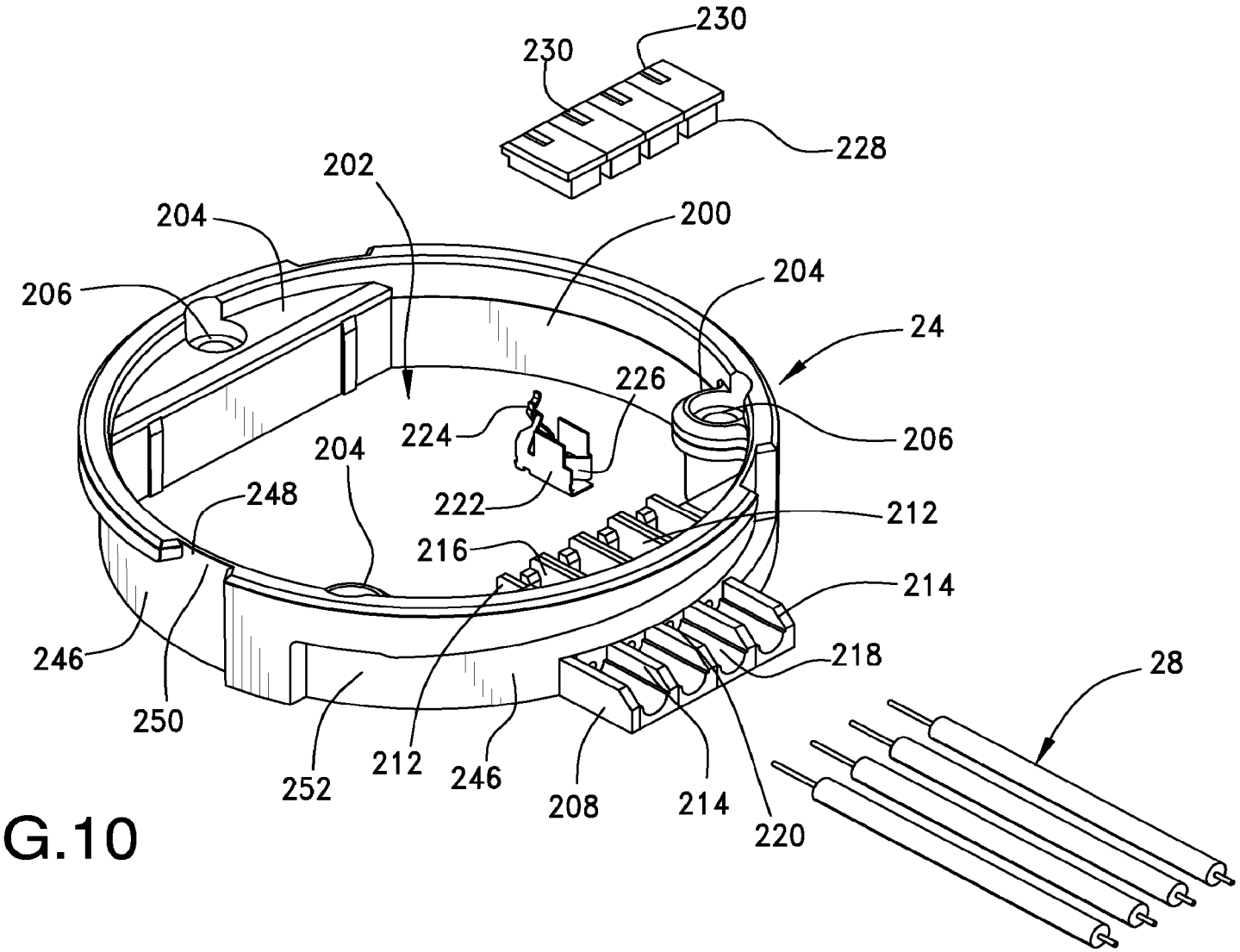
FIG. 10 is a top perspective view of a receiver which is a component of the light module, along with conductors which are attached to the receiver.
Figure 11:
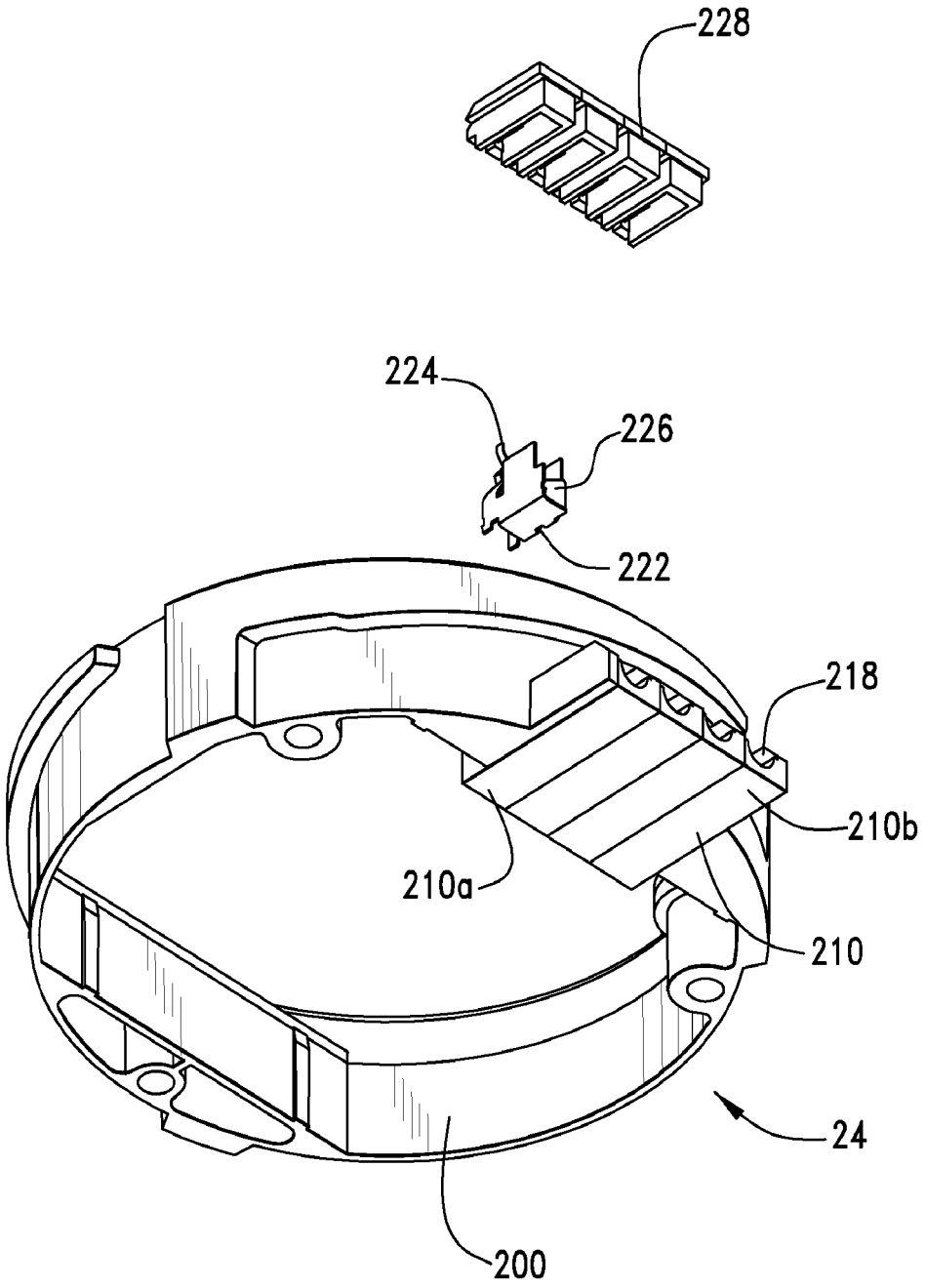
FIG. 11 is a top perspective view of the receiver.

The receiver 24, as depicted in FIGS. 10 and 11, includes a circular base wall 200 having a passageway 202 therethrough. A plurality of frame supports 204 extend inwardly from the inner surface of the base wall 200. Each frame support 204 commences at the lower end of the base wall 200 and terminates below the upper end of the base wall 200. As shown, three frame supports 204 are provided. An aperture 206 is provided through each frame support 204.

The lower end of the base wall 200 has a connector housing 208 into which the conductors 28 can be mounted. As depicted, the connector housing 208 includes a lower wall 210 which has a portion 210*a* that extends inwardly from the inner surface of the base wall 200 a predetermined distance and a portion 210*b* that extends outwardly from the outer surface of the base wall 200 a predetermined distance, a plurality of spaced apart upstanding walls 212 extending upwardly from the portion 210*a*, and a plurality of spaced apart upstanding walls 214 extending upwardly from the portion 210*b*. Wire receiving channels 216 are formed by the portion 210*a* and the upstanding walls 212 on the inside of the base wall 200, and wire receiving channels 218 are formed by the portion 210*b* and the upstanding walls 214 on the outside of the base wall 200. The respective wire receiving channels 216, 218 align with each other. A plurality of apertures 220 are provided through the base wall 200 to connect the respective wire receiving channels 216, 218 together.

A terminal 222 is mounted in each wire receiving channel 216. In an embodiment, the terminal 222 includes a pair of arms 224 which can be configured to engage opposite sides of the free end of the respective terminal 60 when the LED assembly 22 is mounted therein. The terminal 222 may also include a wire trap 226 which is configured to receive a respective conductor 28, however, the conductor may be coupled to the terminal 222 in any desired manner such as via crimping or soldering. The arms 224 are configured to engage a contact being inserted in a direction that is perpendicular to a direction that a conductor would be inserted into the wire trap 226. As shown, the conductors 28 are wires which have their ends stripped and the stripped ends engage with the wire traps 226.

The receiver 24 includes an insulative cover 228 which has a plurality of spaced apart slots 230 provided therethrough. The insulative cover 228 forms part of the connector housing 208. The cover 228 seats over the upstanding walls 212 and covers the channels 216 and terminals 222 to prevent a user from touching the terminals 226. The slots 230 align with arms 224. Since a user cannot touch the terminals 222, the lamp 20 is suitable for use with higher voltage inputs such as AC line voltage (e.g., 120 or 220 VAC) while providing a touch-safe design. In an embodiment, the circuitry 85 can be configured to convert AC line voltage into lower DC voltage and can also include controls so as to allow for receipt of signals that controls the light output. In certain embodiments, for example, the terminals 60 can comprise two blades suitable for receiving power and two blades for receiving control signals. In a further embodiment, the circuitry 85 can include an antenna and the light module may be configured to receive wireless signals that can be used to control the light output.

The passageway 202 of the receiver 24 receives the LED assembly 22 therein. The lower end of the base wall 180 of the frame 44 seats on the upper ends of the frame supports 204, and the lower extension 190 (with the components inside) and the heat spreader 36 seat within the passageway 202. Since there are at least three frame supports 204, this prevents the LED assembly 22 from being tilted as the LED assembly 22 is inserted into the receiver 24. The free ends of the terminals 60 pass through the slots 230 and the continued insertion causes the legs 224 to separate and engage the sides of the terminals 60. The cutouts 184 align with the apertures 204 and the base wall 180 sits on top of the frame supports 204 to ensure proper support for the LED assembly 22. The LED assembly 22 can move upwardly and downwardly relative to the receiver 24 but as depicted, does not rotate with respect to the receiver 24.

The outer surface of the base wall 200 has a plurality of generally L-shaped slots 246 formed thereon. The opening 248 of each slot 246 is at the upper end of the base wall 200. Each slot 246 has a first leg 250 which extends perpendicularly downwardly from the upper end of the base wall 200 and a second leg 252 which extends from the lower end of the first leg 250, and extends downwardly and around the outer surface of the base wall 200. As a result, the surfaces which form the upper and lower walls of the second legs 252 form ramps. As shown, three slots 246 are provided on the outer surface of the base wall 200. The ends of the second legs 252 opposite to the respective first legs 250 may be open to the lower end of the base wall 200.

Figure 12:
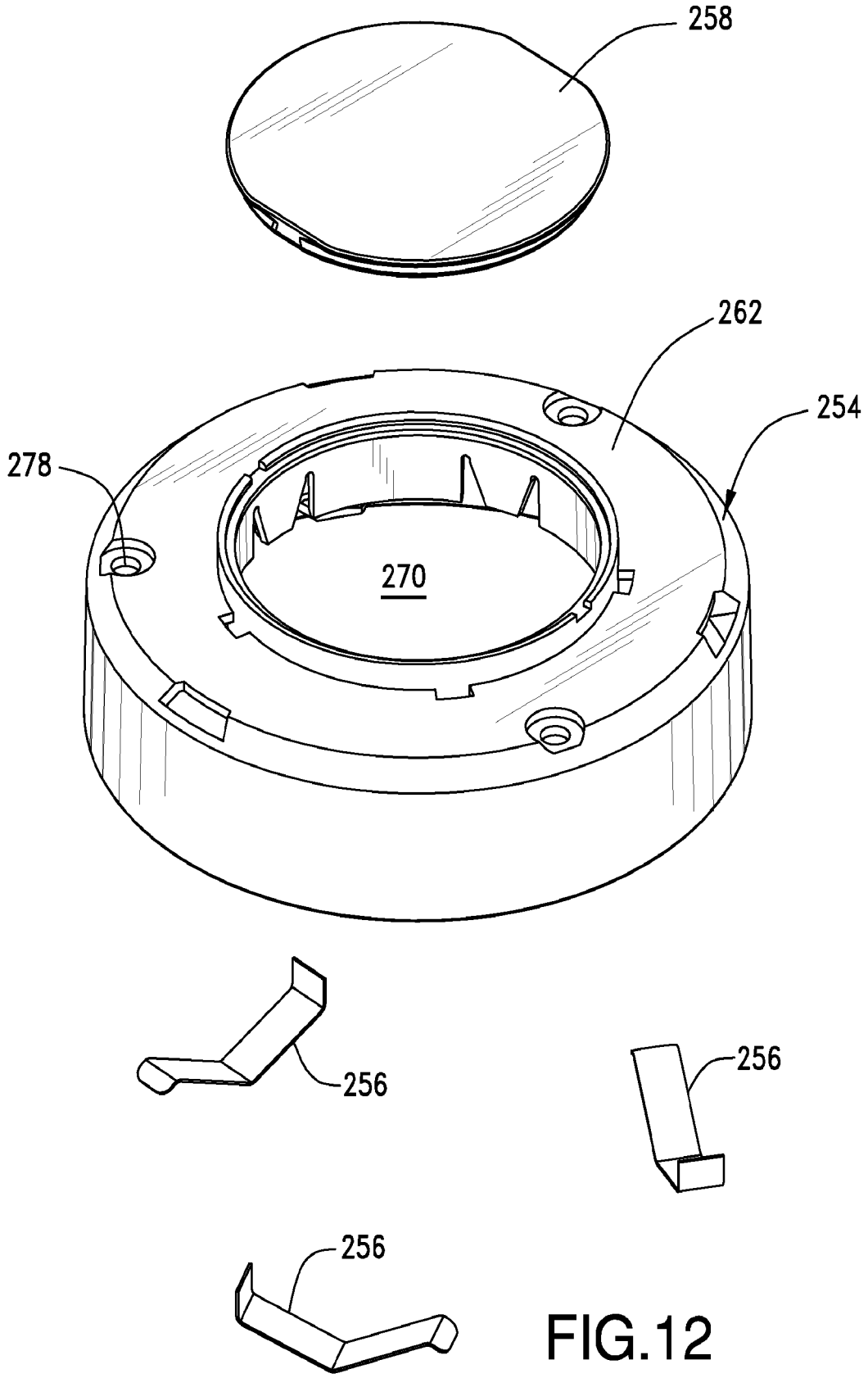
FIG. 12 is a top perspective view of a cover assembly which is a component of the light module.
Figure 13:
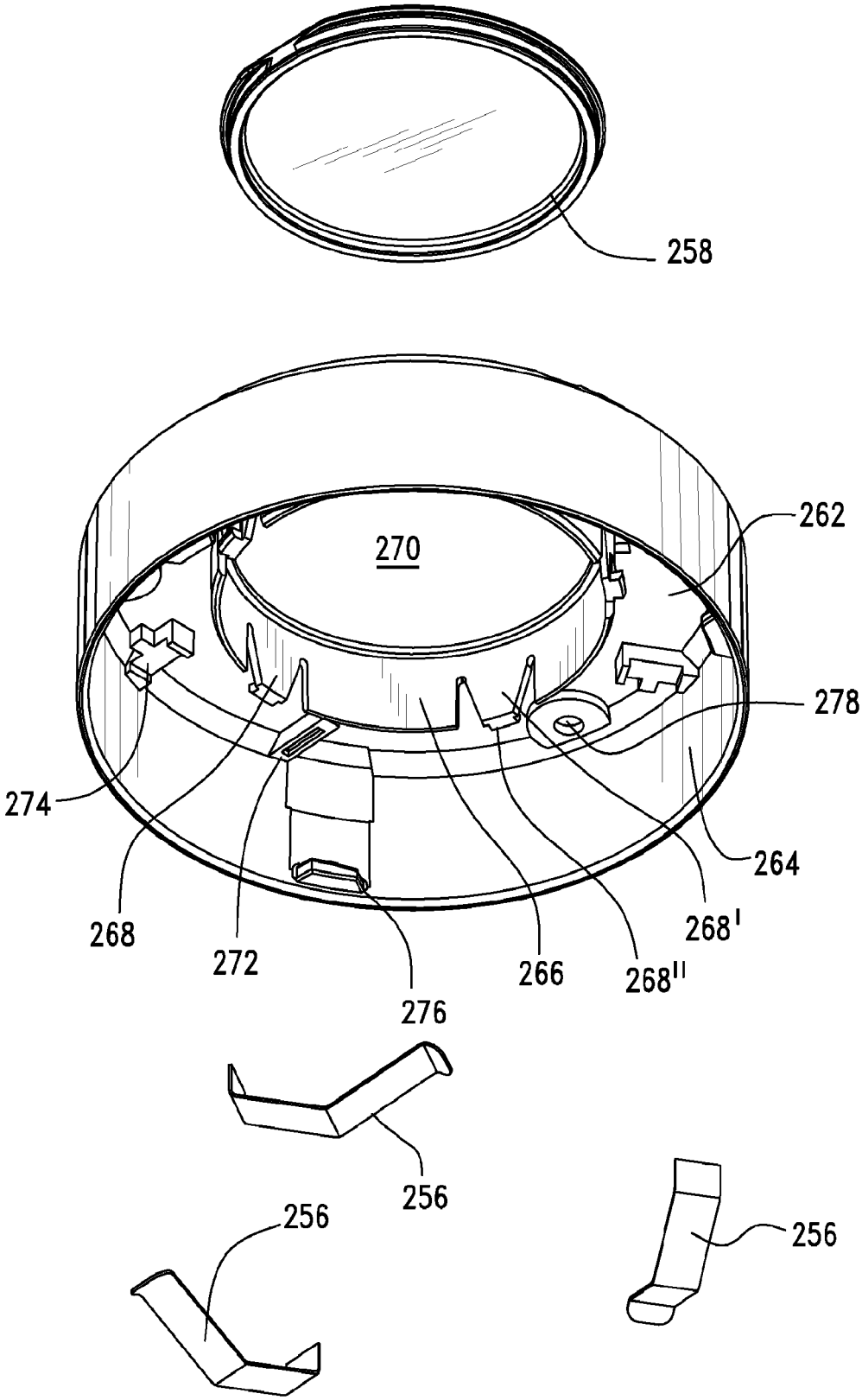
FIG. 13 is a top perspective view of the cover assembly.

The cover assembly 26, FIGS. 12 and 13, includes a cover 254 that supports a biasing element 256, which could be a plurality of springs, and may also include the depicted lens 258 (which could be a simple diffuser or any desired lens). The cover 254 pivotally mounts to the frame 44 and the biasing element 256 is sandwiched between the cover 254 and the frame 44. As shown, the biasing elements 256 are leaf springs, however, it is contemplated that other types of biasing elements can be used, such as a compressible rubber or other compressible materials.

The cover 254 includes an upper circular wall 262, a base wall 264 extending downwardly from the outer edge of the upper wall 262, a plurality of flanges 266 and holding projections 268 depending downwardly from the inner edge of the upper wall 262. The flanges 266 and the holding projections 268 alternate around the circumference of the upper wall 262 and are used to rotatably secure the cover assembly 26 to the frame 44. A central passageway 270 is formed by the flanges 266 and the holding projections 268 into which the upper extension 186 of the frame 44 and the reflector 42 are seated. The flanges 266 and the holding projections 268 have a height which is less than the height of the base wall 264, however, the flanges 266 and the holding projections 268 have a height which is greater than the combined height of the base wall 180 and upper extension 186 of the frame 44. Each holding projection 268 includes a flexible arm 268' extending from the upper wall 262 with a head 268" at the end thereof.

Three pairs of spring retaining housings 272 and spring mounting housings 274 extend downwardly from the bottom surface of the upper wall 262. The associated pairs of housings 272/274 are equi-distantly spaced apart from each other around the circumference of the upper wall 262. A spring 256 is attached to the associated pair of housings 272/274. For each pair of housings 272/274, one end of the spring 256 is fixed to the spring retaining housing 272 and the other end of the spring 256 seats on top of the spring mounting housing 274. As a result, each spring 256 can move from an unflexed position where the apex of the spring 256 is farthest away from the upper wall 262, to compressed position where the apex of the spring 256 is closest to upper wall 262, or to any position in between the unflexed position and the compressed position.

Projections 276 extend inwardly from the inner surface of the base wall 264 proximate to the lower edge thereof. As depicted, three projections 276 are equi-distantly spaced apart from each other around the circumference of the base wall 264 so as to provide even distribution of forces. The projections 276 are proximate to the spring retaining housings 272.

Three apertures 278 extend through the upper wall 262 at equi-distantly spaced positions around the upper wall 262. The apertures 278 can be used to attach a decorative outer cover (not shown) to the cover 254.

The cover 254 is mounted on the frame 44 such that the springs 256 are sandwiched between the upper wall 262 of the cover 254 and the base wall 180 of the frame 44. The flanges 266 and the holding projections 268 pass through the aligned passageway 188, 182 (in the space between the reflector 42 and the upper extension 186) through the upper extension 186 and the base wall 180 and abut against the inner surfaces of the upper extension 186 and the base wall 180. The flexible arms 268' of the holding projections 268 move inwardly as the heads 268" are slid along the inner surface of the upper extension 186 and base wall 180. Once the heads 268" clear the lower end of the base wall 180, the holding projections 268 resume their original state. As a result, the cover 254 and the frame 44 are snap-fit together such that the holding projections 268 prevent the removal of the cover 254 from the frame 44. Because the holding projections 268 have a length which is greater than the combined height of the base wall 180 and the upper extension 186, the cover 254 can move upwardly and downwardly and (as depicted) rotate relative to the frame 44.

The receiver 24 is mounted on the support surface 328, 328'. Thereafter, the cover assembly 26/LED assembly 22 is mounted to the receiver 24. The projections 276 pass through openings 248 of slots 246 and into the first legs 250. A user translates the cover assembly 26 (as depicted, the translation is a rotation) which causes the biasing element 256 to compress between the upper wall 262 of the cover 254 and the base wall 180 of the frame 44. The cover assembly 26 can be rotated relative to the frame 44 and the receiver 24, with the projections 276 sliding along the ramped second legs 252 of the slots 246. As the cover 254 is rotated, the ramped surface of the slots 246 causes the cover 254 to translate downward toward the receiver 24. Thus, the cover 254 and biasing element 256 push against the base wall 180 of the frame 44 and cause the LED assembly 22 to move downwardly relative to the receiver 24. However, the frame 44 moves vertically while the cover 254 translates in two directions (e.g., is rotated and moves downward). The ability to have a predominantly vertical translation of the heat spreader 36 and the corresponding thermal pad 38 helps ensure there is sufficient force between the heat spreader 36 and the support surface 328, 328' (e.g., places the thermal pad 38 is in compression so that a good thermal connection between the heat spreader 36 and the support surface 328, 328' is obtained) without undesirably affecting the mating interface between the thermal pad 38 and the support surface 328, 328'. The translation causes the terminals 60 of the LED assembly 22 to move into contact with the second legs 224 of the terminals 222. Once the final desired position is attained, the biasing element 256 (which can rotate with the cover 254 as depicted or can be a compliant-type material that the cover 254 slides over) helps ensure a continual force is exerted so as to keep the thermal pad 38 in compression between the heat spreader 36 and the support surface 328, 328'. Due to the expected long life of the lamp 20 (30-50,000 hours, it is expected that a steel-based alloy may be a beneficial spring material as it tends to have good resistance to creep and/or relaxation due to thermal cycles. As a result, a desirable low thermal resistivity between the heat spreader 38 and the support surface 328, 328', preferably less than 5 K/W is provided. In an embodiment, the light module 20 can be configured so that less than 5 K/W thermal resistivity between the LED array 52 and the support surface 328, 328' is provided. In an embodiment, the thermal resistivity between the LED array 52 and the support surface 328, 328' can be less than 3 K/W and in highly efficient systems the thermal resistivity can be less than 2 K/W, as noted above.

The lens 258 is mounted in the passageway 270. The cover 254 and lens 258 helps protects the LED assembly 22 from damage. The lens 258, in combination with the reflector 42, can have the desired optical configuration to shape the light emitted from the LED array 52 as desired.

Figure 14:
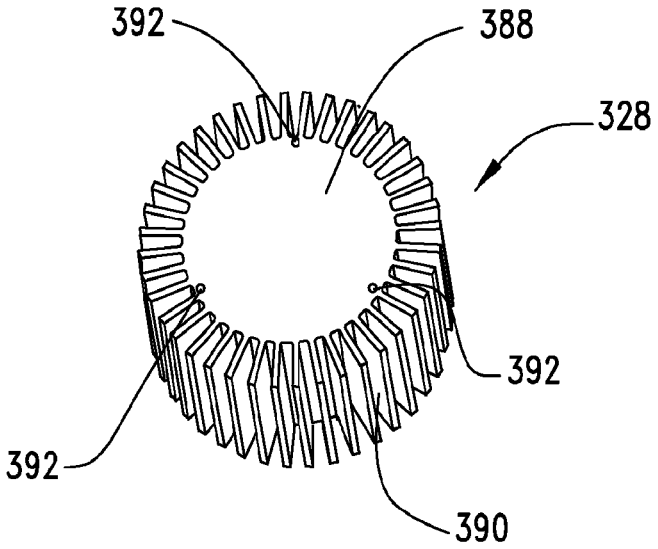
FIG. 14 is a perspective view of an exemplary embodiment of a heat sink.
Figure 15:
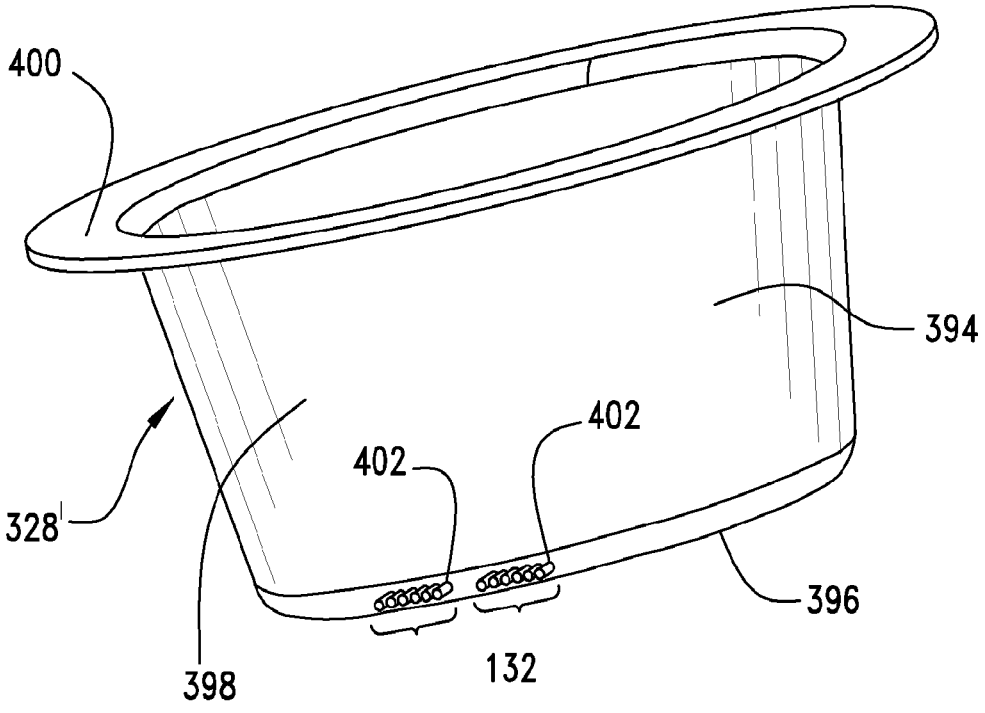
FIG. 15 is a perspective view of another exemplary embodiment of a heat sink.

To provide good thermal dissipation, the support surface 328, 328', see FIGS. 14 and 15, can be formed of a thermally conductive material such as aluminum, copper or the like. Other possible alternatives include conductive and/or plated plastics, it being appreciated and expected that for larger heat sinks the limiting factor will be the environment temperature rather the material used for the heat. However, as heat sink design is known, the particular details can be determined based on environmental factors (such as the amount of heat energy that need to be dissipated and the temperature of the environment).

As can be appreciated, the support surface 328, 328' includes various optional features that may be used independently or coupled together. The first feature is a heat sink 328 that is shown in FIG. 14 and includes a base 388 and a plurality of spaced-apart, elongated fins 390 radially extending from the base 388. The base 388 has a recess (not shown) in its lower end. A plurality of apertures 392 are provided through the base 388 and align with the apertures 206 through the frame supports 204 for receiving fasteners for connecting the receiver 24 to the base 388. The second feature is support member 328' as shown in FIG. 15, which includes a cup-like housing 394. The cup-like housing 394 has a lower wall 396, a circular side wall 398 extending upwardly therefrom, and a flange 400 extending outwardly from the upper end of the side wall 398. Aperture(s) 402 are provided through the side wall 398 to permit passage of the conductors 28 therethrough for connection to an outside power source. The light module 20 seats within the cup-like housing 394 such that the receiver 24 seats on the lower wall 396. A plurality of apertures are provided through the lower wall 396 and align with the apertures 206 through the frame supports 204 for receiving fasteners for connecting the receiver 24 to the lower wall 396. If the heat sink 328 is used in combination, the fasteners used to connect the receiver 24 to the lower wall 396 can also extend into the apertures 392.

The inner surface of the cup-like housing 396 (which may be faceted in a vertical and horizontal manner, or only in a vertical or horizontal, or without facets if a different effect is desired) may be plated or coated so as to be reflective (with a reflectivity of at least 85 percent in the desired spectrum) and in an embodiment may be highly reflective (more than 95 percent reflective in the desired spectrum) and may be specular. The outer surface of the heat sink 328' and the support member 328" may have a similar reflectivity to the inner surface but can be diffuse. In certain applications, providing a diffuse finish on the outer surface can help allow the light module 20 to blend in and essentially disappear when installed in a fixture, thus improving the overall aesthetics of the resultant light fixture. The diffuse finish can be provided by a different coating and/or by providing a textured surface that tends to scatter light. For other applications, the inner surface and the outer surface can independently have either a specular or a diffuse appearance (for a possible four combinations). Thus, in an embodiment the cup-like housing 396 can have a different finish on the inner surface than the outer surface.

It should be noted that the surface of the support surface 328, 328' may not be uniform or have a high degree of flatness. To account for such potential variability, a thicker thermal pad 38 might provide certain advantages that overcome the potential increase in thermal resistance that the use of a thicker thermal pad 28 might otherwise entail. Therefore, the ability to adjust the thickness of the thermal pad 28 and the force exerted by the biasing member 256 is expected to be beneficial in increasing the reliability of the system so as to help ensure desired thermal resistivity.

As can be appreciated, if there is a desire to change the LED assembly 22 (for example, to use an improved LED that offers greater efficiency), the LED assembly 22 and cover assembly 26 can be detached from the receiver 24/support surface 328, 328' by rotating the LED assembly 22/cover assembly 26 the opposite way and removing the LED assembly 22/cover assembly 26 from the receiver 24. Thereafter, a new LED assembly 22/cover assembly 26 can be attached to the receiver 24 in the manner described herein.

The LED array 52 could be a single LED or it could be number of LEDs electrically coupled together. As can be appreciated, the LED(s) could be configured to function with DC or AC power. The advantage of using AC LEDs is there is may be no need to convert conventional AC line voltage to DC voltage. The advantage of using DC based LEDS is the avoidance of any flicker that might be caused by the AC cycle. Regardless of the number or type of LEDs, they may be covered with a material that takes the wavelength generated by the LED and converts it to another wavelength (or range of wavelengths). Substances for providing such conversion are known and include phosphorous and/or quantum-dot materials, however, any desirable material that can be excited at one wavelength range and emit light at other desirable wavelengths may be used. Furthermore, if desired, the conversion materials can be positioned some distance from the LEDs so as to minimize the heat experienced by the conversion material.

While the shown configuration of the light module 20 has the slots 246 on the receiver 24 and the projections 276 on the cover 254, the slots 246 can be provided on the cover 254 with the projections 276 on the receiver 24, it being understood that such a design would likely not be considered touch safe. In addition, while the depicted configuration of the light module 20 has the biasing element 256 mounted on the cover 254, the biasing element 256 could instead be mounted on the frame 44.

While a preferred embodiment of the present invention is shown and described, it is envisioned that those skilled in the art may devise various modifications of the present invention without departing from the spirit and scope of the appended claims.

The invention claimed is:

1. An illumination system comprising:

a receiver configured to be mounted on a support surface, the receiver having a plurality of terminals attached thereto and including a first wall;

a light emitting diode (LED) assembly positioned in the receiver, the LED assembly including a frame that includes a base wall, a cup that includes a base with an aperture and a second wall that extends up from the base and a board positioned in the cup, the board supporting electrical circuitry configured to convert AC voltage to DC voltage and including at least a first and second electrical conductor, the cup filled with a potting material that extends from the second wall such that the potting material substantially covers the board, wherein the cup is positioned in the frame;

a cover, a biasing element attached to the cover, the cover translatably coupled to the LED assembly, the biasing element is positioned between the cover and the base wall of the frame wherein the cover is configured in operation to engage the first wall and rotate with respect to the first wall and wherein the LED assembly is configured to translate vertically with respect to the first wall without substantial rotation and urge the LED assembly against the support surface; and an LED module with an anode and cathode and an LED array, the LED module positioned in the aperture such that the first and second electrical conductor respectfully engage the anode and cathode, wherein the receiver includes a plurality of slots that contain the plurality of terminals, the slots configured such that the plurality of terminals are touch-safe and the LED assembly supports a plurality of blades, the blades configured to engage the terminals in the slots.

2. The illumination system of claim 1, wherein the LED assembly includes a heat spreader that is thermally coupled to the LED module and is configured to be thermally coupled to the support surface.

3. The illumination system of claim 2, wherein the LED assembly is configured such that the thermal resistance between the LED array and the support surface is less than 2 K/W.

4. The illumination system of claim 1, wherein the LED assembly further includes a reflector surrounding the light emitting diode and supported by the cup.

5. The illumination system of claim 1, wherein the blades extend from a side of the LED assembly.

6. The illumination system of claim 5, wherein the blades are supported by the board and extend out a notch in the second wall.

7. The illumination system of claim 1, wherein the electrical circuitry comprises an antenna.

8. A light module, comprising:

a frame;

a cover rotateably coupled to the frame:

a biasing element positioned between a base wall of the frame and the cover a heat spreader coupled to the frame;

a cup positioned between the heat spreader and the frame, the cup including a base, an aperture in the base and a wall extending up from the base;

a board positioned in the cup, the board include a first and second electrical contact and circuitry configured to convert AC voltage to DC voltage;

a light emitting diode (LED) module positioned in the aperture and including an anode and a cathode, the anode and cathode electrically coupled, respectively, to the first and second electrical contact;

a plurality of blades extending out from the wall and electrically coupled to the board; and potting material positioned in the cup and substantially covering the circuitry.

9. The light module of claim 8, further comprising a reflector aligned with the LED module.

10. The light module of claim 9, wherein the reflector is supported by the cup.

11. The light module of claim 10, further comprising a lens supported by the cover, the lens aligned with the reflector.

12. The light module of claim 8, further comprising a connector mounted on the board, the connector supporting the plurality of blades, wherein the connector is aligned with a notch in the wall and the blades extend from an internal side of the wall to an external side of the wall.

13. The light module of claim 8, wherein the circuitry is configured to convert 120 VAC input to DC voltage.

14. The light module of claim 8, wherein the plurality of blades includes at least four blades, wherein two of the blades are configured to provide a control input.

15. The light module of claim 8, wherein the potting material extends from the wall toward the aperture.

16. The light module of claim 15, wherein the potting material is configured to be substantially a height of the wall.

17. The light module of claim 8, wherein the circuitry comprises an antenna.

* * * * *